United States Patent [19]

Denbow et al.

[11] Patent Number: 5,007,115

[45] Date of Patent: Apr. 16, 1991

[54] ADJUSTABLE HEAD AND NECK GARMENT

[76] Inventors: Nancy A. Denbow, 31197 Niakwa Rd., Evergreen, Colo. 80439; Anne M. Bertino, 9605 S. 48th St., #2047, Phoenix, Ariz. 85044

[21] Appl. No.: 479,342

[22] Filed: Feb. 13, 1990

[51] Int. Cl.[5] ..... A42B 1/06; A42B 1/04

[52] U.S. Cl. ..... 2/208; 2/202; 2/203

[58] Field of Search ..... 2/208, 202, 203, 204

[56] References Cited

U.S. PATENT DOCUMENTS

| | | | |
|---|---|---|---|
| 2,581,366 | 1/1952 | DeGrazia | 2/203 |
| 2,839,757 | 6/1958 | Gianola | 2/205 |
| 2,998,611 | 9/1961 | Schuessler | 2/202 |
| 3,747,124 | 7/1973 | Zientara | 2/202 |
| 3,838,467 | 10/1974 | Zientara | 2/202 |
| 3,968,521 | 7/1976 | Bashlow | 2/203 |
| 4,593,417 | 6/1986 | Brown, Jr. et al. | 2/209.1 |

FOREIGN PATENT DOCUMENTS

| | | | |
|---|---|---|---|
| 204512 | 8/1939 | Switzerland | 2/202 |
| 22806 | of 1914 | United Kingdom | 2/208 |

*Primary Examiner*—Werner H. Schroeder
*Assistant Examiner*—Gloria Hale

[57] ABSTRACT

A tubular garment (10) which is worn around the neck and optionally at a variety of positions on the head, to provide protection which can easily be adjusted in response to weather conditions. Wearing positions range from covering the neck only, to covering the entire head, including the mouth, cheeks and forehead. The garment's tubular shape is characterized by having the ends (12 and 14) of the tube at angles of less than 90 degrees to the sides of the tube. The angled ends provide the adjustability in wearing positions by creating a variation in the length of the tube sides from a maximum at the back (26) of the garment to minimum at the front (16). The end (12) of the tube which optionally covers the head is further characterized by a drawstring (20) which allows adjustment in the circumference of the end, thus providing a means of securing the garment in the chosen wearing position.

8 Claims, 2 Drawing Sheets

ADJUSTABLE HEAD AND NECK GARMENT

BACKGROUND

1. Field of Invention

This invention relates to head and neck wear, specifically a garment which can be worn in a variety of positions to provide adjustable protection.

2. Discussion of Prior Art

Outdoor activity during cold weather can subject a person to uncomfortable, and potentially dangerous exposure, and heat loss from the head and neck areas. While this problem can be solved by wearing traditional hats and scarves, we sought to improve on hats and scarves by designing a simple, one-piece, adjustable head and neck garment.

Numerous styles of knitted hats provide head, neck, and face protection. Examples of this style include U.S. Pat. No. 2,998,611, "Cuffed Cap and Face Hood and Method of Forming", U.S. Pat. No. 3,747,124, "Cap and Face Hood, and U.S. Pat. No. 3,838,467, "Cap and Elastic Face Hood". While these designs provide adjustable head and neck protection by including a neck and face covering which telescopes into the cap portion, they are all of knitted construction. Disadvantages of knitted construction include: 1. The tight fit flattens the wearer's hair, creating an unattractive appearance when the cap is removed. 2. The knit provides less wind, rain, and snow protection than modern outerwear fabrics.

Other designs such as U.S. Pat. No. 2,839,757 "Head Covering Garment", and U.S. Pat. No. 4,593,417, "Convertible Survival Cap" provide adjustable neck and face protection by including material which covers the neck and or face. These garments can be constructed of water and wind proof fabrics, thus providing better protection than knitted garments. They do still require a tight fitting cap which flattens the wearer's hair.

All of the aforementioned garments and other similar existing designs provide some degree of flexibility in the coverage of the neck and face areas. Such designs do not provide much flexibility in the head coverage; the wearer may be able to adjust the ear coverage, but must keep the cap on the top of the head at all times. Such designs also require a tight fitting cap portion to hold the garment on the head. The tight fit flattens the wearer's hair, creating an unattractive appearance when the garment is removed. This effect causes many people, especially females, to avoid wearing such garments.

Traditional hood garments can solve the aforementioned problems with cap garments by being constructed of weather proof materials and providing a looser fit on the head. Disadvantages of traditional hoods include: 1. Such garments are commonly attached to a jacket or coat, thus can not be worn separately. 2. The shape of the head and face portions limits the wearing positions to either completely over the head, or completely off the head. The traditional shape, characterized by right angle relationships between the back, top, and front (face) portions of the hood creates this limitation.

OBJECTS AND ADVANTAGES

The object of the present invention is to provide a head and neck garment which overcomes the aforementioned disadvantages of existing garment designs. The garment is designed to fit loosely over the wearer's head so as not to flatten the wearer's hair. The garment may be constructed of any pliable fabric, thus allowing the option of weather proof protection. The garment is not attached to a jacket or coat, thus it may be worn with a variety of outerwear. The garment's unique shape provides a full range of wearing positions on the neck and head. Other advantages include: Coverage of the upper back and shoulders under the wearer's coat or jacket, thus eliminating cold air leaks in this area. The loose fit creates an insulating air space between the wearer's body and the garment. The loose fit and choice of materials eliminate skin irritation (itching) commonly associated with knitted head and neck garments.

DRAWING FIGURES

REFERENCE NUMERALS IN DRAWINGS

Figure 1:
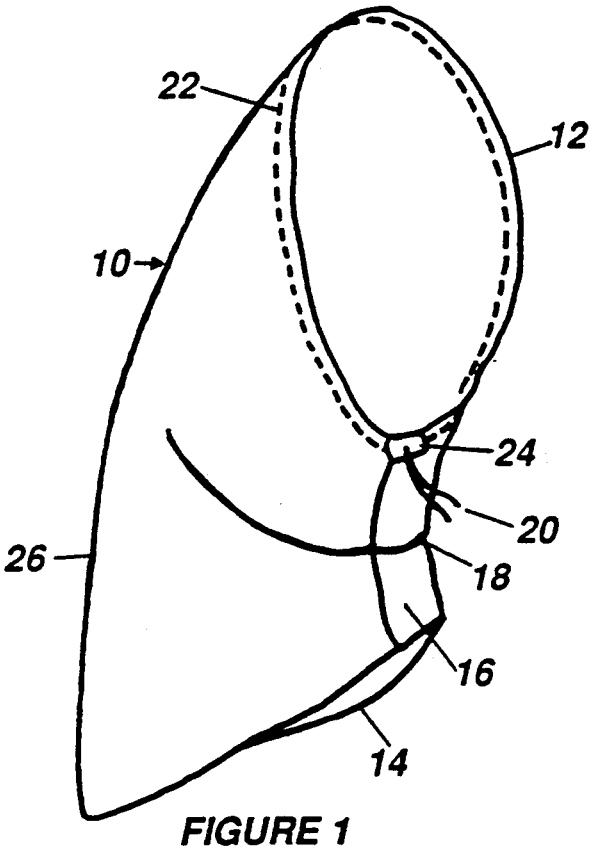
FIG. 1 is a perspective view of the invention as it appears when not being worn.

10 garment
12 face end
14 shoulder end
16 front
18 pleat
20 drawstring
22 drawstring casing seam
24 clamp
26 back
28 front line
30 front line to end angle

DESCRIPTION—FIGS. 1,2

Figure 2:
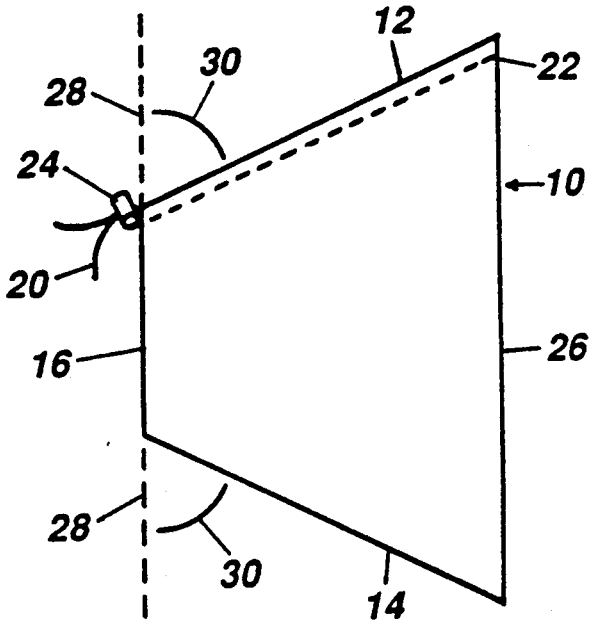
FIG. 2 is a longitudinal cross-section of the garment illustrating the geometry of its shape.

FIGS. 1–5 illustrate the preferred embodiment of the garment, designated generally by numeral 10. As shown in FIG. 1 the overall shape of the garment is tubular. The ends, designated face end 12, and shoulder end 14, are angled with respect to the sides of the tube. This angle creates a variation in the length of the sides of the tube from the maximum length at back 26, to the minimum length at front 16. FIG. 2 shows a longitudinal cross section illustrating the details of the garment shape geometry; pleat 18 is not represented for this illustration. The cross section of FIG. 2 passes through both the maximum and minimum side lengths, thus creating the essentially trapezoidal cross sectional shape. Angle 30 between ends 12 and 14, and front line 28 ranges from 50 to 88 degrees. In accordance with this angle range, the length of front 16 and the length of back 26 are in a ratio of approximately 1:1.2 to 1:3. The length of front 16 generally corresponds to the measurement of the distance between the wearer's nose and collar bone, and the length of back 26 generally corresponds to the measurement of the distance from the wearer's upper back, over the head, to the forehead. The circumference of tube 10 generally corresponds to the measurement around the wearer's head from the chin to the top back of the head. The exact measurements of the garment vary depending upon the size of the wearer. Front 16 is characterized by a pleat 18 which is generally 0.25 the length of front 16. Pleat 18 creates a slight bend in the overall tube shape. Face end 12 is characterized by a drawstring 20 at the edge of the end. Drawstring 20 is held in place by drawstring casing seam 22 which closely parallels face end 12. Drawstring 20 emerges from the garment at front 16, where its ends extend a short distance. The ends of drawstring 20 are held together by a spring-loaded clamp 24 which allows adjustment of face end 12 circumference. The neck end of the head and neck garment can also be constructed with a drawstring in a casing seam to provide adjustability to the garment and a snug fit to the neck to avoid the infiltration of cold air to the neck area. With this addition the head and neck garment will have drawstrings at both ends. The preferred embodiment is constructed of two layers of fabric. The outer layer is a weatherproof nylon, and the inner layer is a soft, insulating polyester fleece. The layers are attached to each other at face end 12 and shoulder end 14.

OPERATION—FIGS. 3, 4, 5

Figure 3:
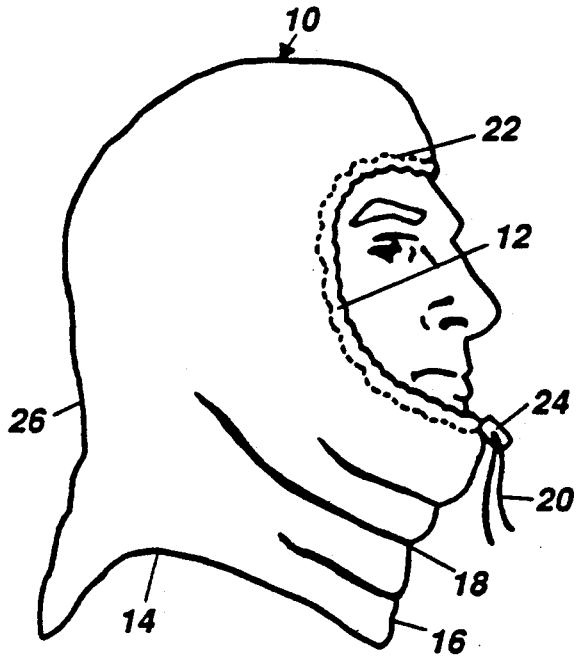
FIG. 3 is a profile view of the invention as it appears when worn fully covering the head.
Figure 4:
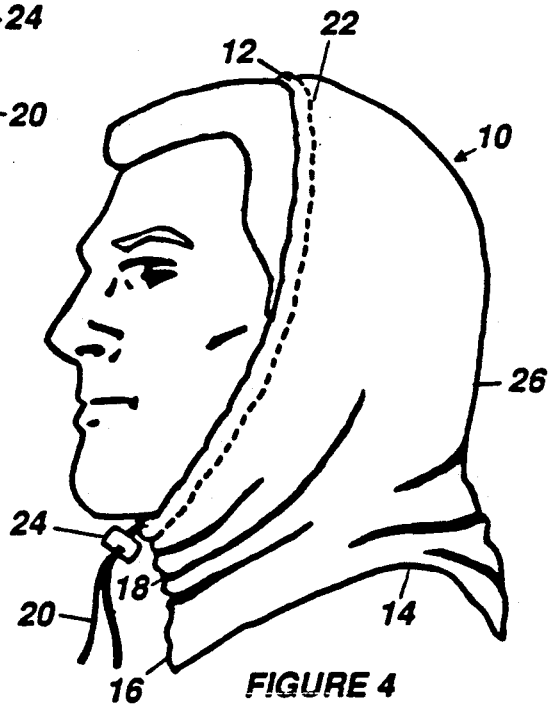
FIG. 4 is a profile view of the invention as it appears when worn in an intermediate position covering the ears and lower head.
Figure 5:
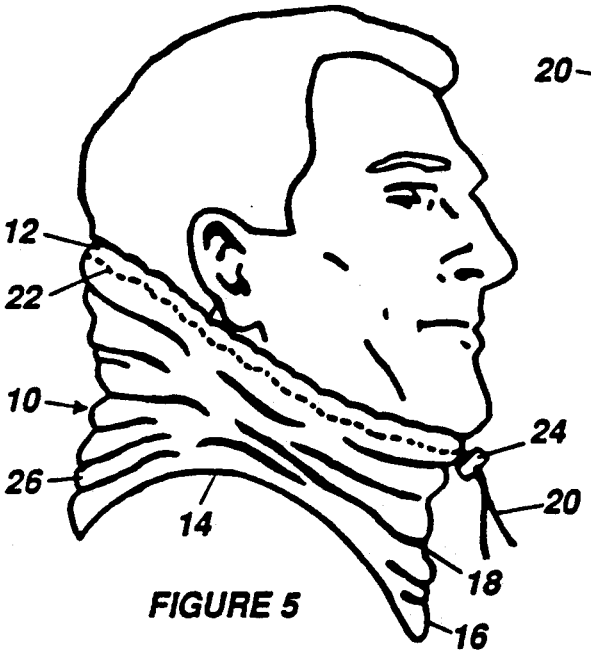
FIG. 5 is a profile view of the invention as it appears when worn covering the neck only.

The garment is worn over the neck and head by placing tube 10 over the head and around the neck. Front 16 is placed at the front of the wearer's neck, below the chin, with back 26 at the back of the wearer's neck and head. Shoulder end 14 remains around the wearer's shoulders and upper back, while face end 12 can be raised and lowered over the head to respond to current weather conditions. Drawstring 20 can be tightened or loosened, and held in place with clamp 24, as necessary to accommodate the chosen wearing position. FIGS. 3, 4 and 5 illustrate three possible wearing positions. FIG. 3 shows the garment covering the whole head, while leaving only the face exposed. FIG. 4 shows the garment covering the neck, lower head, and ears with the upper head exposed. FIG. 5 shows the garment covering the neck only. Wearing positions can vary infinitely from low around the neck with drawstring 20 loosened, to covering the head, forehead, cheeks and mouth with the drawstring tightened.

SUMMARY, EMBODIMENTS, AND SCOPE

The garment of the present invention provides adjustable head and neck protection for cold weather use. The garment provides numerous advantages over existing, traditional head and neck garment designs. The advantages include fully adjustable wearing positions on the neck and head which can easily be changed to respond to current weather conditions, and a loose fit on the head which does not create an unattractive appearance when the garment is removed. The garment may be constructed of weather proof fabric which provides better protection and does not cause skin irritation common with knitted materials.

In the preferred embodiment the front has a seam which is permanently sewn together; an alternate embodiment could be characterized by a separable front seam which would be joined together and separated as necessary by the wearer. A separable front seam would require some means, such as snaps, a zipper, etc. of joining the two sides. The preferred embodiment employs a spring loaded clamp for securing the drawstring ends; an alternate embodiment could use a different method of securing the drawstring adjustments, such as simply tieing a knot. The preferred embodiment employs two layers of fabric; an alternate embodiments could be constructed of other materials with more layers or just one layer.

Variations in embodiments may be made within the scope of the invention described above, thus the specifications described serve as illustrations and are not to be construed to limit the scope of the invention.

What is claimed is:

1. An adjustable head and neck garment comprised of a tubular shaped body, with the sides of the tube varying in length from a maximum on one side of said tube to a minimum on the opposite side, such that the ends of said tube are at acute angles to the body of said tube, wherein a longitudinal cross section of said tube which intersects both said maximum and minimum length sides of said tube has an essentially trapezoidal shape.

2. The garment of claim 1 further including a drawstring at one end of said tubular shaped body, whereby said drawstring provides essentially infinite adjustment in the circumference of said end.

3. The garment of claim 1 further including adjusting means of varying the circumferences of both ends of said tubular shaped body.

4. The garment of claim 1 further including a separable seam along said minimum length side.

5. An adjustable head and neck garment comprised of a tubular shaped body, with the ends of the tube at acute angles to the body such that the length of the sides of said tube varies from a minimum on one side of said tube to a maximum on the opposite side, wherein a longitudinal cross section of said tube which intersects both said maximum and minimum length sides of said tube has an essentially trapezoidal shape.

6. The garment of claim 5 further including a drawstring at one end of said tubular shaped body, whereby said drawstring provides essentially infinite adjustment in the circumference of said end.

7. The garment of claim 5 further including adjusting means of varying the circumferences of both ends of said tubular shaped body.

8. The garment of claim 5 further including a separable seam along said minimum length side.

* * * * *